US005664326A

United States Patent [19]

Ohsumi

[11] Patent Number: 5,664,326

[45] Date of Patent: Sep. 9, 1997

[54] METHOD OF MANUFACTURING METAL TERMINAL

[75] Inventor: Hideki Ohsumi, Shizuoka, Japan

[73] Assignee: Yazaki Corporation, Tokyo, Japan

[21] Appl. No.: 604,252

[22] Filed: Feb. 21, 1996

Related U.S. Application Data

[62] Division of Ser. No. 408,291, Mar. 22, 1995.

[30] Foreign Application Priority Data

Mar. 22, 1994 [JP] Japan ..... 6-050208

[51] Int. Cl.[6] ..... H01R 43/16

[52] U.S. Cl. ..... 29/874; 439/595

[58] Field of Search ..... 29/874, 882; 439/595

[56] References Cited

U.S. PATENT DOCUMENTS 4,712,299 12/1987 Loewen et al. ..... 29/882
5,478,263 12/1995 Kato ..... 439/752
5,551,150 9/1996 Zielinski et al. ..... 29/882

FOREIGN PATENT DOCUMENTS 54-174892 12/1979 Japan ..... H01R 13/12
54-174893 12/1979 Japan ..... H01R 13/04
54-166678 12/1981 Japan ..... H01R 13/11
59-37973 10/1984 Japan ..... H01R 13/422
330361 3/1991 Japan ..... H01R 13/115

*Primary Examiner*—P. W. Echols
*Assistant Examiner*—Adrian L. Coley
*Attorney, Agent, or Firm*—Sughrue, Mion, Zinn, Macpeak & Seas

[57] ABSTRACT

In a terminal receiving chamber made of a connector housing of synthetic resin, the metal terminal is retained by the flexible holding strip disposed in the connector housing, the retaining portion of the metal terminal abutting against a retaining projection of the flexible holding strip includes an end part of a laminated plate portion formed by folding a rolling thin plate portion.

4 Claims, 3 Drawing Sheets

METHOD OF MANUFACTURING METAL TERMINAL

This is a divisional of application Ser. No. 08/408,291 filed Mar. 22, 1995.

BACKGROUND OF THE INVENTION

1. Field of the Invention

This invention relates to a terminal retaining structure for a connector and a method of manufacturing a metal terminal which is used for connecting wire harnesses or the like in an automobile.

2. Related Art

In FIG. 4, in a terminal receiving chamber b of a connector housing a, a metal terminal c is retained with a flexible holding strip d to prevent the metal terminal c from being rearwardly disconnected from the terminal receiving chamber b. The metal terminal c has a female-type electric contact part e and a wire connecting portion f. A retaining portion e1 is formed at a rear shoulder part of the female-type electric contact part e. The flexible holding strip d being cantilevered has a retaining projection d1 which is retained with the retaining portion e1.

FIG. 5 is an enlarged view showing a retained part of the flexible holding strip d and the retaining portion e1. An edge e1' is provided at an end portion of the retaining portion e1 when a metal plate is cut along a cross section thereof to form the retaining portion e1. Therefore, it is possible to ensure that a retaining area p of the retaining projection d1 to be connected to the retaining portion e1 is large (the retaining area p corresponds to a distance defined from an end portion of the retaining projection d1 to the edge e1' corresponding to a contact end of the retaining portion e1 close to a proximal end of the retaining projection d1). As a result, a large portion of a projection area g is utilized (the projection area g corresponds to a distance defined between a proximal end and a distal end of the retaining projection d1). However, there is a problem wherein the retaining projection d1 is damaged by a sharp edge formed on the edge of the retaining portion e1.

FIG. 6 shows a structure of an arc corner portion e2' which is formed by bending a retaining portion e2 of the metal terminal c. In this instance, it is possible to avoid the damage to the flexible holding strip d by bending the retaining portion e2 so as to eliminate the edge portion. However, a retaining area p' of the retaining portion e2, corresponding to the retaining projection d1, becomes small, since the arc corner portion e2' is provided. In order to ensure a sufficent engagement, it is necessary to enlarge a projection area g' by enlarging the retaining projection d1 as shown in a dotted line. However, when this is done the whole connector housing is enlarged by increasing the projection area g'.

SUMMARY OF THE INVENTION

The present invention has been made in order to overcome the above problems and drawbacks, and an object of the invention is to prevent the decrease of the retaining area of a flexible holding strip by bending a retaining portion of a metal terminal, which corresponds to a flexible holding strip of a connector housing.

The above object has been achieved by a terminal retaining structure characterized in that, in a terminal receiving chamber of a connector housing made of synthetic resin, a metal terminal is retained by a flexible holding strip which is disposed in the connector housing, a retaining portion of the metal terminal abuts against a retaining projection of the flexible holding strip, and the retaining portion is defined by an end part of a laminated plate portion formed by folding a rolling thin plate portion.

Further, according to the present invention, a method of manufacturing a metal terminal comprises the step of: rolling a part of a punched metal terminal material in an expanded condition from a metal plate material to form a rolling thin plate portion; folding the rolling thin plate portion to form a laminated plate portion; and bending the metal terminal material in the expanded condition to form a metal terminal.

When the retaining projection of the flexible holding strip abuts against the retaining portion, the retaining projection is not damaged, because the retaining portion has an arc surface which is formed by an end of the laminated plate portion.

DETAILED DESCRIPTION OF THE PREFERRED EMBODIMENTS

Figure 1:
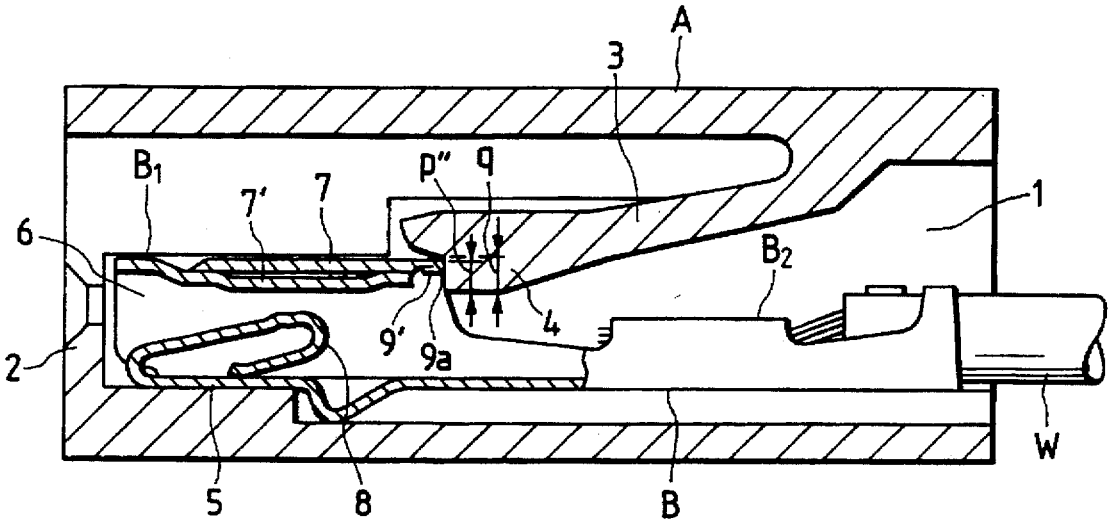
FIG. 1 is a cross-sectional view of one preferred embodiment of the present invention.

In FIG. 1, a reference numeral A designates a connector housing made of synthetic resin, a reference numeral B designates a metal terminal. The connector housing A includes a terminal receiving chamber 1 which is formed to pass through the frontward and rearward ends of the connector housing A. A stopper 2 is provided at a front end in the terminal receiving chamber 1. A flexible holding strip 3 being cantilevered is also provided at a middle part in the terminal receiving chamber 1. A retaining projection 4 with a projection area g is formed on a free end of the flexible holding strip 3 being cantilevered.

The metal terminal B includes a female-type electric contact part B1 and a wire connecting portion B2. A wire W is connected in the wire connecting portion B2 beforehand.

Figure 3A:
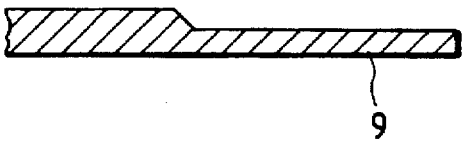
FIG. 3(A) is a cross-sectional view taken along a line X—X of FIG. 2(A)
Figure 3B:
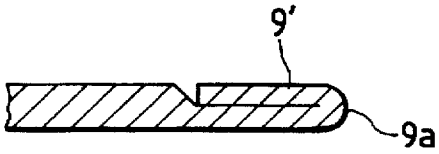
FIG. 3(B) is a cross-sectional view taken along a line Y—Y of FIG. 2(B)
Figure 2A:
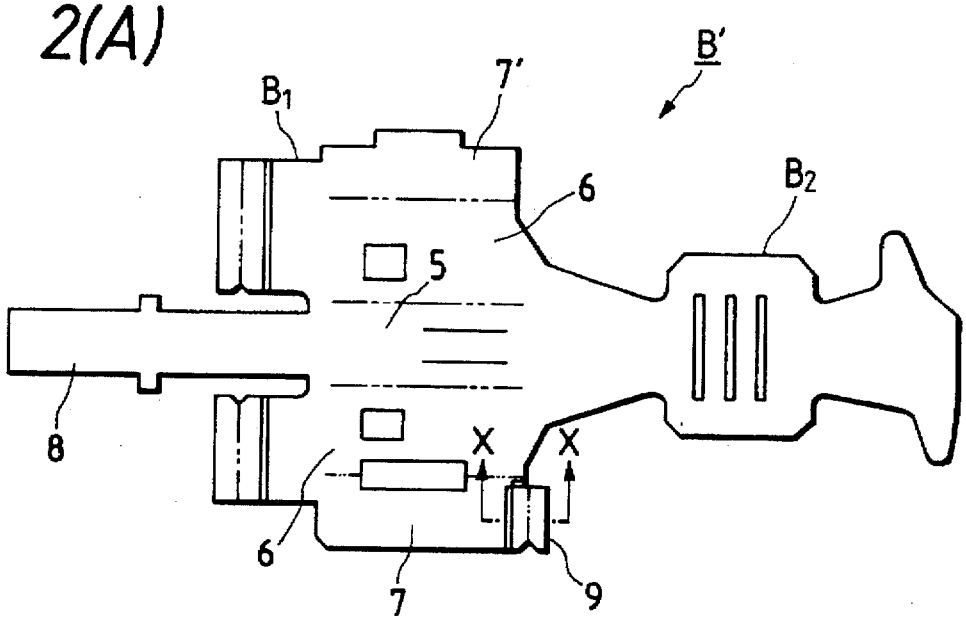
FIG. 2(A) is an expanded view of a metal terminal of the present invention.
Figure 2B:
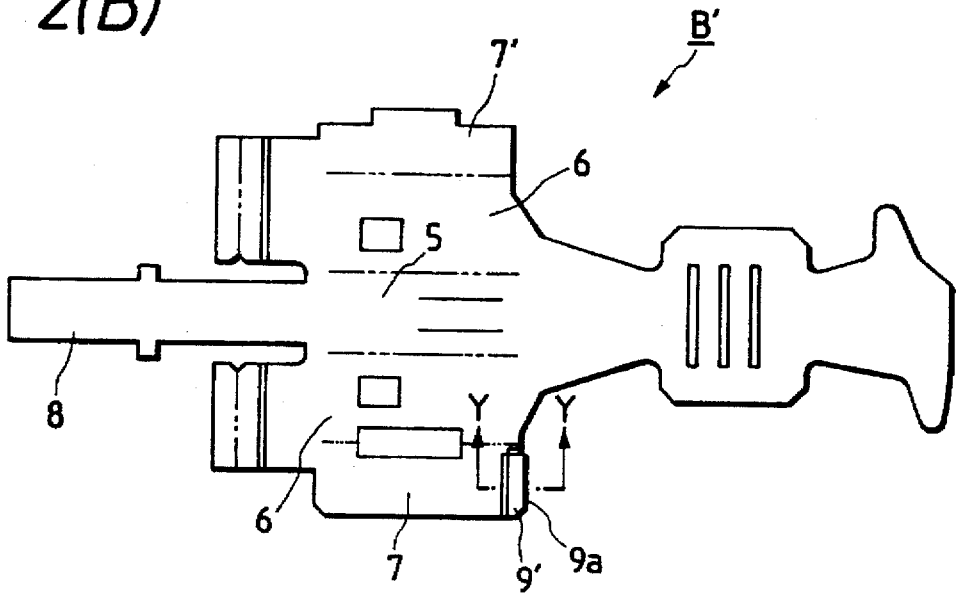
FIG. 2(B) is an expanded view of a metal terminal of the present invention.
Figure 4:
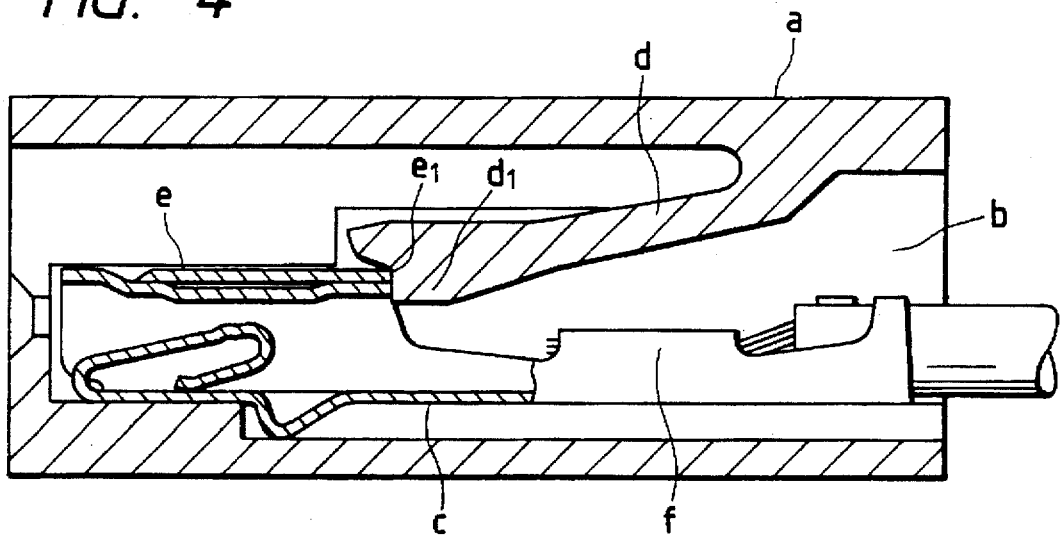
FIG. 4 is a cross-sectional view of a conventional example.

At the female-type electric contact part B1, a top plate portion is stacked on inner top plate portion 7' and is 7 mounted to a bottom plate portion 5 through side plate portions 6, and a folded elastic connecting strip 8 is formed at a tip portion of the bottom plate portion 5. In a punched metal terminal material B' punched from a metal terminal in an expanded condition, first of all, a rolling thin plate portion 9 is formed at a rear end part of the top plate portion 7 in such a manner that the rolling thin plate portion 9 projects backwardly from the inner top plate portion 7' (as shown FIG. 2(A), FIG. 3(A)). Next, a retaining portion 9*a* is formed by frontwardly folding a front end of the rolling thin plate portion 9 to form a laminated plate portion 9' (as shown FIG. 2(B), FIG. 3(B)), and the metal terminal B of FIG. 1 is formed by a bending process from this condition shown in FIG. 2(B) and FIG. 3(B).

Figure 5:
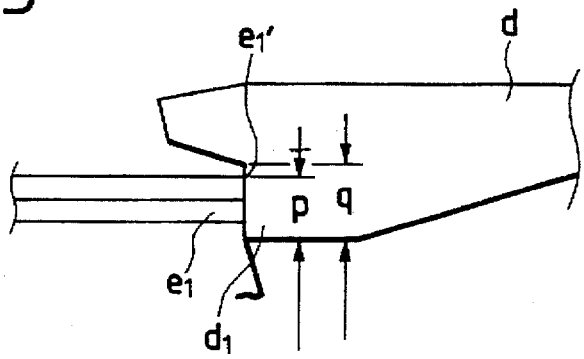
FIG. 5 is an enlarged view showing a main part of FIG. 4.
Figure 6:
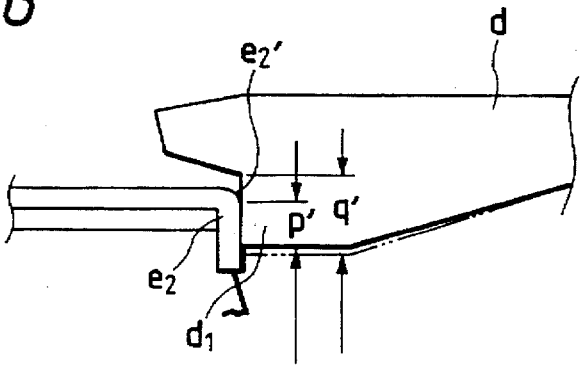
FIG. 6 is a cross-sectional view of another conventional example.

As described above, it is possible to minimize an arc corner portion of the retaining portion, since the retaining portion 9*a* of the metal terminal B is formed by folding the rolling thin plate portion 9. A retaining area p" of the retaining portion 9*a* abutting against the retaining projection 4 is substantially same as the retaining area p corresponding to the edged retaining portion of the convention example (as shown in FIG. 5).

In the present invention, a metal terminal is ensurely retained through a retaining portion by a flexible holding strip without enlarging the flexible holding strip and connector housing. Moreover, the retaining portion does not apply damage to the flexible holding strip.

Further, in the method of manufacturing the metal terminal of the present invention, it is possible to easily manufacture a metal terminal having a retaining portion at the end part of a laminated plate portion by folding a rolling thin plate portion.

What is claimed is:

1. A method of manufacturing a metal terminal, comprising the steps of:

punching a metal plate to form a terminal blank;

rolling a predetermined portion of the terminal blank so as to reduce the thickness of said predetermined portion and thereby form a thin plate portion;

folding the thin plate portion to form a laminated plate portion; and bending the terminal blank to form said terminal.

2. The method of claim 1, wherein after said bending step, said laminated plate portion is disposed on a top plate portion of said metal terminal and extends in a direction opposite an insertion direction of said metal terminal.

3. The method of claim 2, wherein said laminated plate portion is formed by folding said thin plate portion in a U-shaped manner, thereby forming a folded edge on said laminated plate portion.

4. The method of claim 1, wherein said metal terminal is insertable into a terminal receiving chamber of a connector housing of the type in which said terminal receiving chamber has a flexible holding strip with a retaining projection, and wherein said folded edge of said laminated plate portion abuts said retaining projection when said metal terminal is retained in said terminal receiving chamber.

* * * * *